United States Patent [19]

Flood

[11] 4,134,383

[45] Jan. 16, 1979

[54] DRAWING INDICATOR FOR BOWS

[75] Inventor: John D. Flood, Stow, Ohio

[73] Assignee: Charles R. Iden, Akron, Ohio ; a part interest

[21] Appl. No.: 759,003

[22] Filed: Jan. 13, 1977

[51] Int. Cl.[2] ..... F41B 5/00

[52] U.S. Cl. ..... 124/24 R; 124/87; 124/88; 340/372

[58] Field of Search ..... 124/23 R, 24 R, 86, 124/87, 88, 90; 33/265; 116/124 L, 124 R, DIG. 34; 200/161, 61.93; 340/213 R, 220, 282, 366 R, 372, 421

[56] References Cited

U.S. PATENT DOCUMENTS

| | | | |
|---|---|---|---|
| 3,450,122 | 6/1969 | Diamond | 124/24 R |
| 3,597,555 | 8/1971 | Gould | 200/161 X |
| 3,643,052 | 2/1972 | Marshall | 200/161 X |
| 3,866,592 | 2/1975 | Carella | 124/86 X |
| 3,867,920 | 2/1975 | Westphal | 124/24 R |

*Primary Examiner*—Richard C. Pinkham
*Assistant Examiner*—William R. Browne
*Attorney, Agent, or Firm*—Oldham, Oldham, Hudak & Weber

[57] ABSTRACT

A bow drawing indicator for attachment to a bow and including a switch device having a spring operating arm extending therefrom for movement in one direction to successively contact and close two different circuit contacts, a flexible member connecting said arm to said bowstring to move said operating arm to circuit closing positions with drawing movement of said bowstring, a pair of indicator lights, and power circuits connecting individually to the lights to actuate one light on partial tensioning of said bowstring and to actuate the second light on continued drawing of said bowstring.

4 Claims, 4 Drawing Figures

DRAWING INDICATOR FOR BOWS

BACKGROUND OF INVENTION

Heretofore there have been various efforts made to provide drawing indicators for bows inasmuch as bow and arrow shooting and archery hunting have become more popular in recent years and the bow and arrow devices have required greater accuracy in the sighting of the arrow, and the accuracy of shooting has been controlled both by the sighting actions as well as by the tension provided in the drawstring. Thus, various types of sighting equipment is provided on or available for use with most bows as made commercially today, and efforts have been made heretofore to provide an indication when the drawstring of the bow is pulled back to a proper length for obtaining the desired tension for shooting the bow accurately.

Reference is made to the structures such as shown in U.S. Pat. Nos. 3,867,920; 3,660,059; 3,866,592; 3,499,414 and 3,450,122. However, these sighting or drawing indicator devices as provided heretofore have in some instances required special arrows to be used therewith, or attachments have been provided on the bow that may be difficult to use in association with the arrow, the devices are relatively complicated or expensive, or the devices just have not provided a truly effective, convenient signal to indicate when the proper drawing action is obtained, and mostly these indicators have failed to provide any indication when an excessive drawing action is set up in the bow.

One particular problem that has been encountered by the archer in accurately sighting or aiming an arrow is to determined accurately when the arrow has been drawn back on a bowstring to the most desirable position for shooting the arrow and providing the proper tension in the drawstring for accurate firing of the arrow. Such action must be obtained without diverting the archer's attention from properly sighting the arrow at the time of its release so that a further difficulty is encountered in maintaining the head or tip end of the arrow in proper relation to the arrow shelf or rest section provided on the bow at the central stock or shank body part thereof.

Furthermore, recently many bows used for most sophisticated hunting or target shooting actions have comprised so-called compound bows wherein further controls or limitations are placed on the sighting, drawstring tension, drawstring drawing allowance, etc. since all of such factors combine to control the ultimate accuracy of the archer and determine whether or not a satisfactory shooting action can be obtained.

By my present invention, I have been able to resolve the above-identified difficulties by relatively simple operating means that can be readily attached to existing bow and arrow units. These means include a connector member operatively engaging the bowstring and connected to a multi-contact switch device for movement so as to close one or both of a pair of electric circuits for energizing one or both of two associated signaling means in such a manner that the archer will know when the arrow has been drawn back to a desired shooting position and when the drawstring has been pulled back further than a desired drawstring position. Such signaling means are provided to the archer in visual association with the sighting mechanism on the bow whereby the archer does not need to worry about the proper tensioning or drawing action of the drawstring and he can just position the arrow in conventional engagement with the positioning shelf on the bow in the usual manner while obtaining conventional sighting of the arrow by a visual indication readily apparent to the archer without diversion from his conventional or normal sighting action while simultaneously obtaining a bow drawing indication to signal when he is ready for arrow release.

It therefore is the general object of the present invention to overcome the foregoing problems and difficulties of prior types of bow drawing indicators and to provide an indicator apparatus which readily and accurately indicates to the archer when the drawstring is suitably tensioned or drawn in the bow and arrow assembly for most accurate arrow shooting action.

Another object of the invention is to provide a bow drawing indicator that can be readily attached to existing bow and arrow units.

Another object of the invention is to provide a relatively small, lightweight, inexpensive unit that has good service life and provides convenient reliable information to an archer for bow drawing and archery shooting actions.

Yet another object of the invention is to improve the accuracy of an archer, and to facilitate obtaining proper bowstring drawing action in an arrow sighting situation whereby the archer can obtain accurate bow drawing information while concurrently sighting the arrow for most effective shooting thereof.

The foregoing and other objects and advantages of the invention will be made more apparent as the specification proceeds.

Reference now is particularly directed to the accompanying drawings, wherein.

When referring to corresponding members shown in the drawings and referred to in the specification, corresponding numerals are used to facilitate comparison therebetween.

SUBJECT MATTER OF INVENTION

Figure 1:
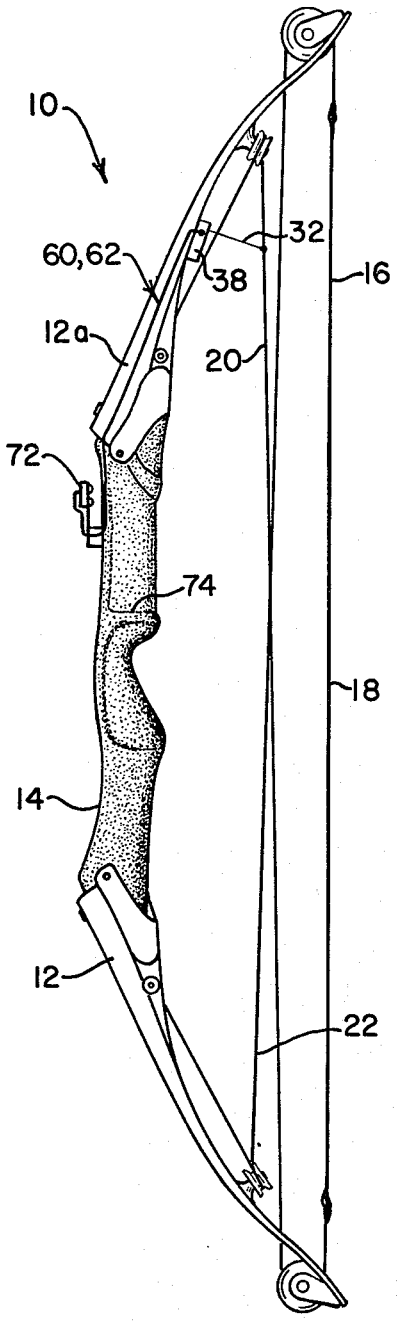
FIG. 1 is an elevation of a compound bow and bowstring assembly having a bow drawing indicator means of the invention operatively associated therewith.

A bow drawing indicator for attachment to a bow having a bowstring and comprising a unit including a multi-contact switch device having a spring operating arm extending therefrom for movement in one direction to successively contact and close two circuits, a flexible member connecting said arm to said bowstring to move said operating arm successively to circuit closing positions with drawing movement of said bowstring, a frame mounting a pair of indicator lights thereon, and power circuits connecting individually to said lights and switch to actuate one light initially on partial tensioning of said bowstring and to close the circuit to said second light on continued drawing of said bowstring, said unit and said frame being mountable on a bow.

Now with reference to the details of the construction shown in the drawings, a conventional compound bow 10 is shown which includes the frame 12 having a center section 14 and a drawstring 16 operatively secured to the frame 12 in a conventional manner. The bowstring includes operative section 18 and connector sections 20 and 22 for the bowstring and by which it is attached to the upper and lower limbs of the frame 12.

Figure 2:
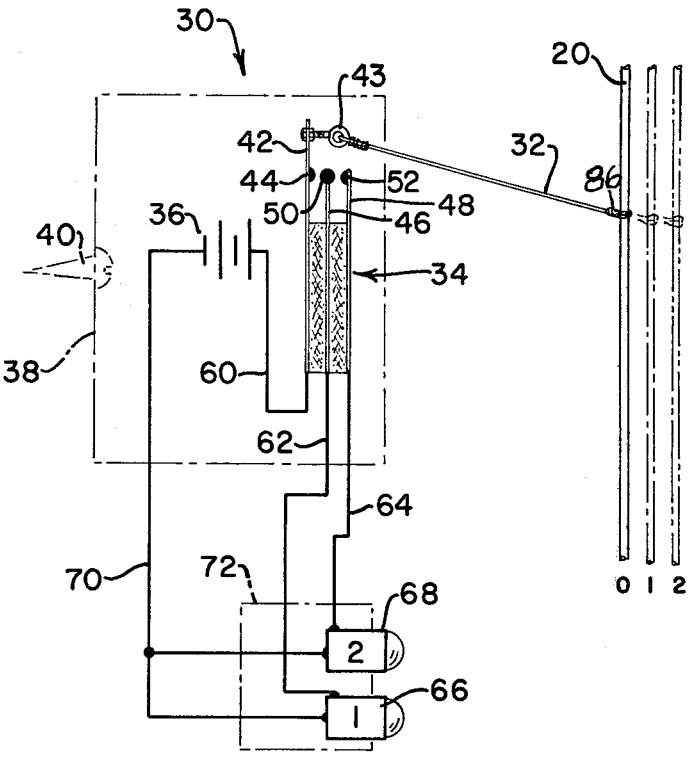
FIG. 2 is a diagrammatic showing of electric circuit and power supply means used with the apparatus of the invention and indicating its operative connection to a bowstring.

FIG. 2 shows a bow drawing indicator 30 of the invention which includes a flexible connector cord or device 32 one end of which is suitably attached to the connector section 20 or other portion of the bowstring. The opposite end of this flexible cord 32 extends to a control or switch means such as a multi-contact switch 34. This switch 34 and a suitable power source such as a battery 36 preferably are secured together in any conventional manner so as to provide or be enclosed in a box or frame device 38 which is secured, as by the use of an attachment screw 40 to the upper limb **12*a* of the frame 12**.

The multi-contact switch 34 normally comprises a flexible switch arm 42 extending from the switch and having the opposite end of the flexible cord 32 secured thereto by a member as an eye 43. Such spring arm 42 has a contact 44 formed thereon or secured thereto, and a pair of adjacent switch or contact arms 46 and 48 are provided positioned usually parallel to at least a portion of the spring arm 42. Each arm has individual contacts 50 and 52 formed thereon, the relationship of the members in the unit switch 34 being such so that with movement of the spring arm 42 in the direction of towards the drawstring 16, the contact 44 thereon is brought into engagement with the contact 50 on the arm 46 by such initial movement and with continued movement of the spring arm by further tensioning of the drawstring 16, then another portion of the contact 50 engages the contact 52 on the associated spring arm 46. Thus, the different or plurality of contact engagements made in the multi-contact switch 34 in the manner described permits two circuits to be controlled thereby. FIG. 2 shows that a lead 60 connects the battery 36 to the spring arm 42, while individual leads 62 and 64 extend from ends of the spring arms 46 and 48 to individual indicator devices, such as lights 66 and 68, respectively. A common lead 70 connects opposite sides of the lights 66 and 68 back to the battery 36.

The drawings show these lights 66 and 68 positioned in a suitable carrier frame 72 and that this carrier frame 72 is mounted on the center section 14 of the bow frame at the sighting area thereof and normally slightly vertically above the arrow shelf 74 on this frame. The lights 66 and 68 usually are vertically aligned but can be in any desired relationship. Now, when an archer engages an arrow indicated in dotted lines in the drawings with the bowstring 16 and starts to pull it to operative condition for arrow release, he will be looking at the normal sighting device provided on the center frame section 14 and at the same time he will see the two lights 66 and 68 positioned immediately adjacent his arrow and sighting means therefor. The arrangement of the unit is such, as shown in the drawings, that as the bowstring is initially pulled back to engage the contact 50 with the contact 44, then a circuit is closed to light number 1, and this indicates to the archer that the bowstring drawing is correct to provide desired tension in the string and power for propelling the arrow at the sighting situation established. Should the archer pull the drawstring or bowstring back too far, then the contact 50 is brought into engagement with the second contact 52 to provide power to the light 68. Hence, then both lights would be concurrently illuminated to indicate to the archer he should release the bowstring slightly before complete release of the bowstring for arrow propulsion.

Figure 3:
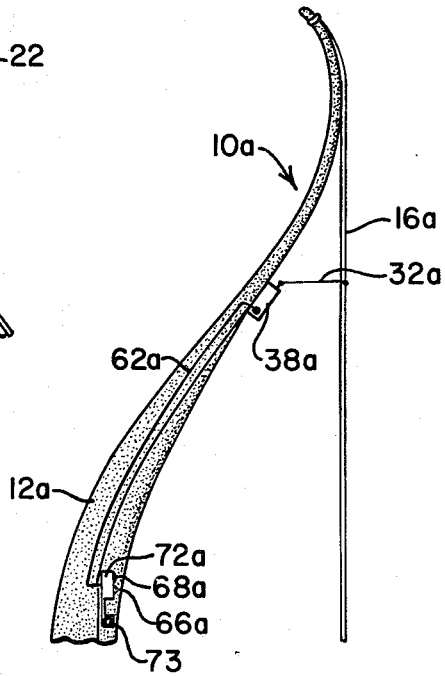
FIG. 3 is an elevation of an end of a simple bow having another embodiment of the apparatus of the invention secured thereto.

The apparatus of the invention can likewise be used with any type of a bow and a simple bow **10*a* is shown in FIG. 3. In this instance, the bowstring 16*a* has a flexible cord 32*a* secured thereto and extending to the frame 38*a* of the switch and battery means provided and which are releasably secured to this frame 12*a*. Suitable leads 62*a* extend from such frame 38*a* down to the frame 72*a* for the lights 66*a* and 68*a*. The frame is removably and adjustably secured to the bow frame 12*a* as by screws 73**, or similar articles so that the apparatus of the invention can be readily attached to the existing bow and arrow devices.

FIG. 1 shows that a unitary lead made of the leads 70, 62 and 64 can extend down along the bow frame and be secured thereto in any conventional manner as by electrical tape, adhesive, or just be pulled under tension over existing portions of the bow frame.

Usually the flexible cords connecting the bowstring or cable to the switch or contact lever arm device are slightly slack to require bow tensioning before closing the switch or contact means.

Figure 4:
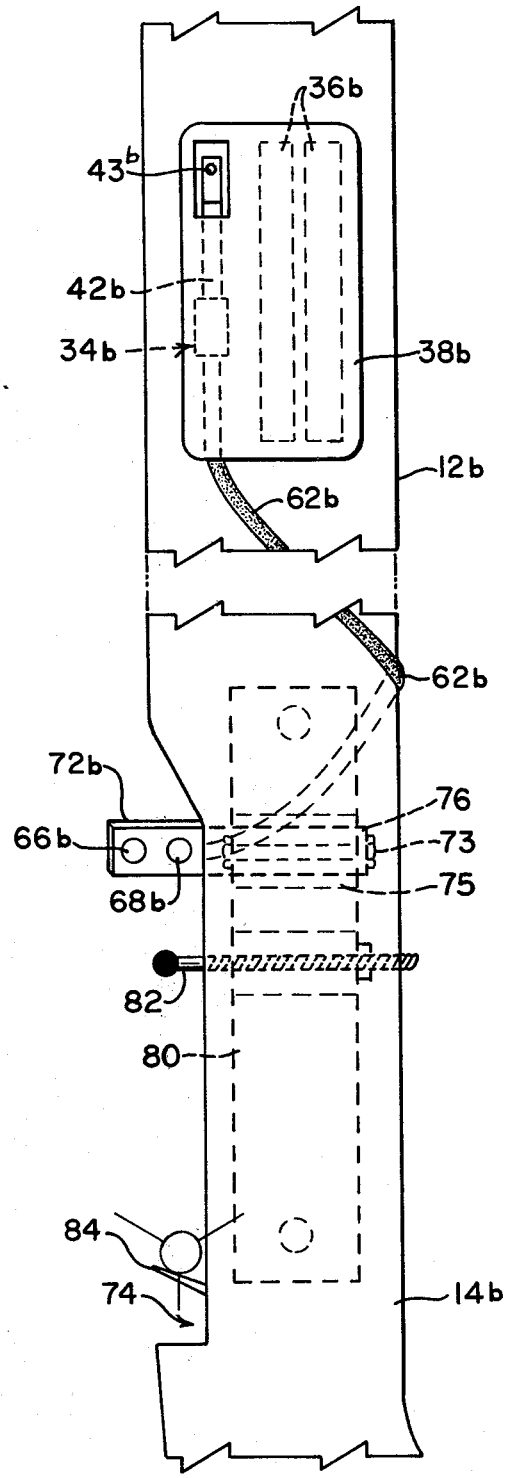
FIG. 4 is an enlarged side elevation, with parts broken away, of the center portion of a further apparatus of the invention.

The indicator means used in the invention are offset laterally from the bow. FIG. 4 best shows a frame **72*b* extending laterally from a bow handle section 14*b* in this right side elevation of a modified bow of the invention. The bowstring and connecting cord are omitted in FIG. 4. The connecting cord would preferably be secured through a hole 43*b* to a lever arm 42*b* of the switch device 34*b*** to connect it to the bowstring.

A conventional sight bracket 80 is shown secured to the outer surface of the bow **12*b*. One or more sighting pins 82 are secured to this bracket 80. The frame 72*b* is secured to this sight bracket 80 or to the bow section 14*b* in any suitable way, as by a screw 73 securing an end flange 76 of the frame to a positioning block 75 on the bracket 80**.

A conventional arrow rest 84 is shown in FIG. 4.

Any suitable release means 86 may connect the cord 32 to the bowstring 20 and such means 86 may include hooks or the like which engage convolutions of a nylon cord that engages the bowstring 20.

The sighting or indicator means of the invention preferably comprise a pair of lights that are readily visible to the archer at the same time that he is obtaining a sighting action for his bow. The archer can readily identify when one of the lights becomes illuminated to indicate correct bowstring drawing action and likewise, the illumination of both lights **66*b* and 68*b*** clearly shows to the archer that he is providing excessive tension in the bowstring and satisfactory arrow firing action will not be obtained. Thus, the archer is facilitated in his sighting and arrow release actions and improved target shooting and hunting accuracy results can be obtained. Thus, the objects of the invention are thought to be achieved.

While several complete embodiments of the invention have been disclosed herein, it will be appreciated that modification of these particular embodiments of the invention may be resorted to without departing from the scope of the invention.

What is claimed is:

1. The combination of a bow having a bowstring, a bow frame, a sighting area and an arrow shelf, and a bow drawing indicator comprising an electrical power unit mounted on said bow frame and including two different power circuits connecting to a multi-contact switch device having a spring arm extending therefrom for movement in one direction to successively contact and close said two different power circuits, a flexible member connecting said arm to said bowstring to move said operating arm successively to circuit closing positions with tensioned drawing movement of said bowstring as it is moved away from the bow frame, a frame device mounting a pair of indicator lights thereon secured to said bow frame, and said power unit having said power circuits connect individually to said lights and switch device, said spring arm being bent to close and actuate said power circuit for one light initially on tensioning said bowstring to move it away from the bow frame, and to close the said power circuit to said second light on continued drawing of said bowstring away from the bow frame to produce further bending of said spring arm, said power unit and said frame device being mounted in spaced vertical relation on said bow frame.

2. The combination of claim 1, where said switch device and spring arm are correlated in position with said flexible member so that said flexible member, when tensioned, moves said spring arm directly towards a first contact means of said multi-contact switch device and then towards a second contact means of said multi-contact switch device to measure the deflection of said bowstring away from said bow frame by actuation of said power circuits and successive lighting of said lights; said power unit being positioned adjacent an end of said bow, and said indicator lights being positioned at the sighting area of the bow above the arrow shelf, and a relatively short movement of said bowstring, away from said bow frame, closes said contacts.

3. The combination of claim 2, where said power circuits, include leads extending from said power unit to said lights and lying against said bow frame, said switch and power unit being a compact, small unit.

4. A bow drawing indicator for a bow having a bowstring, a bow frame, the bowstring being moved away from a center portion of the bow frame; and comprising an electrical power unit for mounting on said bow frame and including two different power circuits connecting to a multi-contact switch device having a spring arm extending therefrom for movement in one direction to successively contact members in and close said two different power circuits, a flexible member for connecting said arm to a said bowstring to move said operating arm successively to circuit closing positions with tensioned drawing movement of said bowstring as it is moved away from the bow frame, a frame device mounting a pair of indicator lights adapted to be secured to said bow frame, and said power unit having said power circuits that connect individually to said lights and switch device, said spring arm being adapted to be bent to close and actuate said power circuit for one light initially on tensioning said bowstring to move it away from the bow frame, and to close the said power circuit to said second light on continued drawing of said bowstring away from the bow frame to produce further bending of said spring arm, said power unit and said frame device being connected by conductors forming parts of said power circuits and connecting to said indicator lights.

* * * * *